United States Patent [19]

Rocklein

[11] Patent Number: 4,860,699

[45] Date of Patent: Aug. 29, 1989

[54] TWO-CYCLE ENGINE

[76] Inventor: John Rocklein, 947 Van Houten Ave., Clifton, N.J. 07013

[21] Appl. No.: 217,719

[22] Filed: Jul. 5, 1988

[51] Int. Cl.[4] ..... F02B 41/00

[52] U.S. Cl. ..... 123/26; 123/531; 123/65 BA; 123/73 C

[58] Field of Search ..... 123/26, 531, 533, 65 BA, 123/73 C, 563, 65 D, 65 WA

[56] References Cited

U.S. PATENT DOCUMENTS

| | | | |
|---|---|---|---|
| 1,205,505 | 11/1916 | Benham | 123/73 B |
| 1,220,893 | 3/1917 | Rundlof | 123/26 |
| 1,720,414 | 7/1929 | Gruebler | 123/559.1 |
| 1,949,577 | 3/1934 | Nordberg | 123/533 |
| 2,085,036 | 6/1937 | Meredith | 123/65 WA |
| 4,398,509 | 8/1983 | Offenstadt et al. | 123/73 AF |
| 4,660,383 | 4/1987 | Leonard | 123/26 |

*Primary Examiner*—David A. Okonsky
*Attorney, Agent, or Firm*—Siegmar Silber

[57] ABSTRACT

A two-cycle internal combustion engine is described having a combination of a combustion chamber portion at one end of the cylinder for receiving predetermined amounts of air and fuel; inlet ports for injecting fuel and compressed air into the upper end of the combustion chamber portion; exhaust ports in the cylinder for the conduction of exhaust gases and air from the combustion chamber portion, said exhaust port means being covered and uncovered by the side of the piston means and positioned to be fully uncovered at the bottom dead center position of the piston; a fuel/air mixing system in communication with the inlet ports the system having an air supply for providing a continuous supply of compressed air to the combustion chamber portion, a supply of compressed air generated by the engine, a fual supply for providing predetermined quantities of fual at specified intervals, and, a precombustion chamber for receiving and mixing the compressed air and the predetermined quantities of fuel and providing the continuously flowing air and the mixture of air and fuel to the inlet port and, a crankshaft housing attached to the lower end of said cylinder and sealed from the combustion chamber portion thereof for housing and lubricating the crankshaft and connecting rod. The two-cycle engine of the invention provides combustion and exhaust with continuously flowing air through the combustion chamber portion and permits lubrication of the crankshaft in the region of perfect lubrication.

19 Claims, 2 Drawing Sheets

TWO-CYCLE ENGINE

FIELD OF THE INVENTION

The present invention relates in general to a two-cycle internal combustion engine. More specifically a two-cycle engine is described wherein an air/fuel mixture is introduced at the head of the cylinder; exhaust exits through ports in the cylinder wall which are uncovered when the piston is at the bottom dead center position; and crankcase oil distribution falls within the area of perfect lubrication.

DISCLOSURE INFORMATION STATEMENT

In preparation for filing of this application, a pre-examination patentability search was performed. Among the classes and subclasses reviewed were Class 123/subclasses 65BA, 559, 531, 533 and 449; Class 60/subclasses 597 to 614; and Class 91/subclasses 410 and 462. The search uncovered the following:

| Patent No. | Inventor | Date of Issue |
|---|---|---|
| 4,660,383 | G. L. Leonard | April 28, 1987 |
| 4,628,888 | P. Derret | Dec. 16, 1986 |
| 4,206,599 | Sumiyoshi et al | June 10, 1980 |
| 2,482,864 | G. Nemnich | Sept. 27, 1949 |
| 2,291,594 | J. Phillips | July 28, 1942 |
| 2,221,405 | F. Nallinger | Nov. 12, 1940 |
| 2,215,911 | A. C. Peterson | Sept. 24, 1940 |
| 2,118,899 | G. Ralston | May 31, 1938 |
| 1,949,577 | B. V. E. Nordbert | Mar. 6, 1934 |
| 1,901,381 | G. P. Smith | Mar. 14, 1933 |
| 1,900,200 | G. B. Poyer | Mar. 7, 1933 |
| 1,893,006 | M. Trechsel | Jan. 3, 1933 |
| 1,829,400 | R. V. Hutchinson | Oct. 17, 1931 |
| 1,825,817 | J. Patterson | Oct. 6, 1931 |
| 1,783,788 | A. H. R. Fredden | Dec. 9, 1930 |
| 1,720,414 | F. Gruebler | July 9, 1929 |
| 1,717,768 | G. Fornica | June 18, 1929 |
| 1,709,269 | O. Kuhnast | April 16, 1929 |
| 1,026,871 | S. Lake | May 21, 1912 |
| 866,654 | V. Jacob | Sept. 24, 1907 |

The patent to Gruebler, U.S. Pat. No. 1,720,414 shows an internal combustion engine designed to overcome problems of operating at high altitudes. To do this, Gruebler provides for an additional air pump. Greubler teaches that the carburetor in the aspiration pipe of the motor may be dispensed with and the whole of the combustible introduced by way of supplementary air. The patent also suggests eliminating valves, when the fuel is injected into the pressure pipe along with the additional air.

Next a General Motors patent, that of Hutchinson, U.S. Pat. No. 1,829,400 (hereinafter '400) and a Daimler-Benz patent, that of Nallinger, U.S. Pat. No. 2,221,405 (hereinafter '405) are considered. In the '400 patent, a supercharge is described which utilizes what is termed a "hot-spot jacket" so as to control the temperature of the incoming carburetted mixture. In the '405 patent, the impeller is driven from the engine for producing the desired supercharging. Other supercharger schemes are disclosed in G.P. Smith, U.S. Pat. No. 1,901,381, and Treschsel U.S. Pat. No. 1,893,006.

Nordberg's diesel engine as described in U.S. Pat. No. 1,949,577 is next discussed. As taught by the inventor, the structure is applicable to either a two-cycle or four-cycle engine. Here the air injection pump is driven from the engine, in timed relation therewith. The compressor furnishes scavenging air and the stage compressor furnishes compressed combustible gas.

While all of these patents share some common elements none of them shows the novel combination of the present invention.

SUMMARY

The invention discloses an improved two-cycle internal combustion engine which concomitantly provides combustion and exhaust with continuously flowing air through the combustion chamber portion while permitting lubrication of the crankshaft in the region of perfect lubrication. The continuously flowing air is provided by either air compressed in the crankshaft housing by the downward stoke of the piston or air compressed externally in a supercharger arrangment. The continuously flowing air is also valuable since, after the exhaust ports are uncovered, the air assists in speedily and completely removing exhaust gases from the cylinder. The exhaust ports are covered and uncovered by the side of the piston and when the piston is at the bottom dead center position, of the exhaust ports are fully uncovered. The engine further provides for mixing supercharged air and fuel in a predetermined manner. The mixing occurs in a precumbstion chamber for receiving and mixing the compressed air and predetermined quantities of fuel. The chamber also provides the continuously flowing air and the mixture of air and fuel to the inlet port of the combustion chamber of the cylinder. With the crankshaft housing arrangement, described in further detail hereinbelow, the providing of the combustible fuel and air mixture is separated from the lubricating process. In the lubrication arrangment of the engine any metal to metal contact is avoided because all contact is accompanied by the presence of an intervening oil film.

BRIEF DESCRIPTION OF THE DRAWINGS

The following is a brief description of the drawings.

DETAILED DESCRIPTION OF THE PREFERRED EMBODIMENTS

Figure 1:
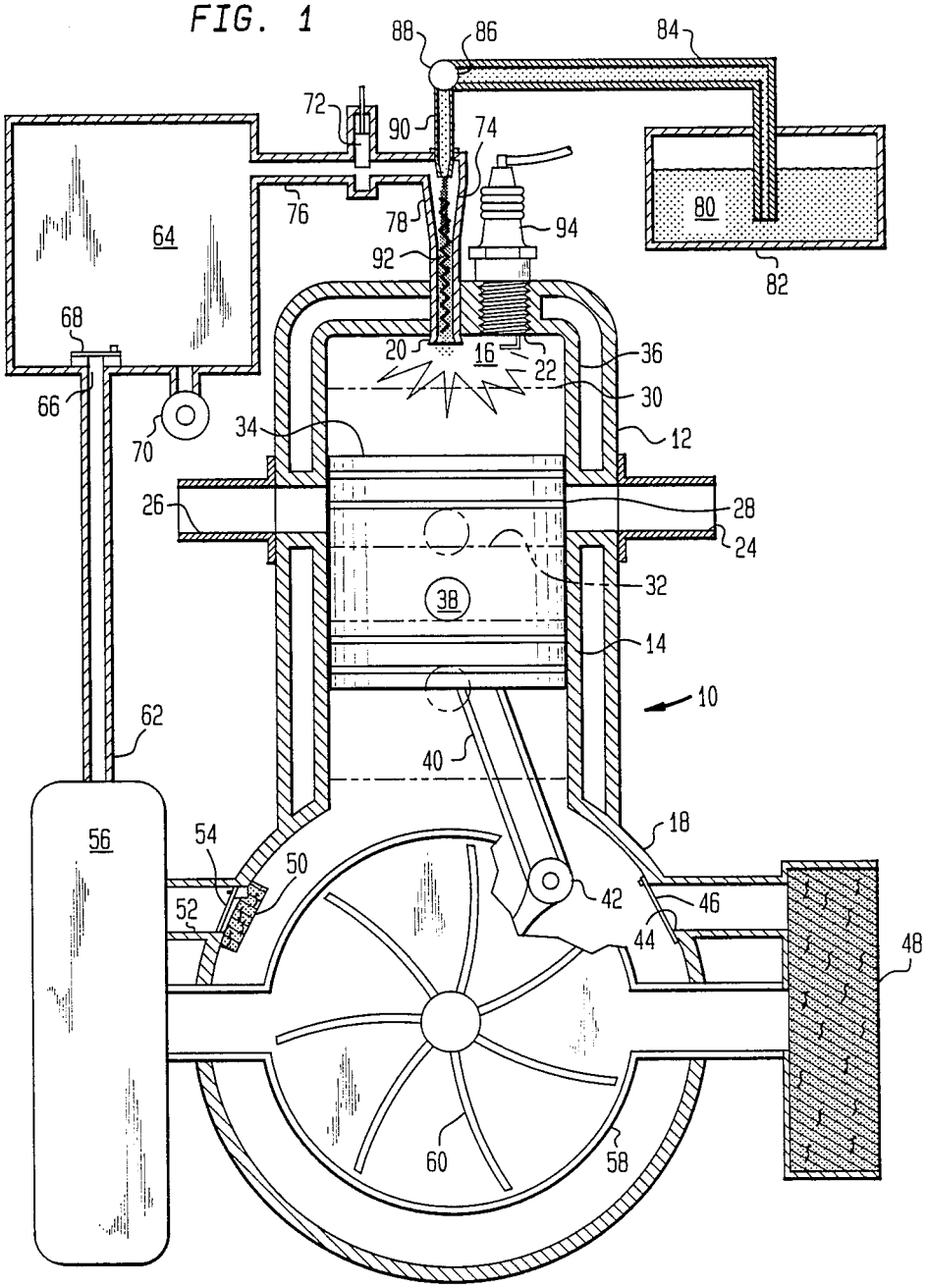
FIG. 1 is a schematic diagram of the two cycle engine of the first embodiment of the present invention which supports combustion with a spark ignition arrangment; and, FIG. 2 is a schematic diagram of the two cycle engine of the second embodiment of the present invention which supports combustion with an automatic ignition arrangement.

Referring now to FIG. 1, a portion of the two-cycle internal combustion engine is shown schematically. The engine shown is the best mode of practicing the present invention and is referred to generally by the numeral 10. The engine 10 is constructed with a cylinder 12 having a cylinder wall 14 extending longitudinally between a combustion chamber portion 16 at one end thereof and a crankshaft housing 18 adjacent the other end thereof. The cylinder wall 14 is further constructed to include a precombustion port 20, an ignition or spark plug port 22 and two exhaust ports 24 and 26. Within the cylinder 12, a piston 28 is reciprocally mounted so as to be operable between a top dead center position 30 at which combustion occurs and a bottom dead center position 32 at which exhausting of combustion products occurs. The piston 28 has a crown 34 which, when the piston 28 is at the top dead center position 30, forms with the upper end 36 of cylinder wall 14 the combustion chamber portion 16. Although the cylinder 12 is shown in an orientation with the upper end 36 towards to top of the illustration, the term "upper" refers for convenience to a prescribed portion of the cylinder and is not to be restrictive as to the positioning thereof, such positioning being determined by those skilled-in-the-art. The piston 28 has a piston pin 38 attaching thereto one end of a connecting rod 40 through the lower end of the piston 28. The other end of connecting rod 40 is attached to a crankshaft 42 in the normal manner.

In the two-cycle engine of the present invention, as the crankshaft housing 18 is separated from the combustion/exhaust processes of the engine 10, the shaft and bearing arrangement (not shown) may be structured for what is traditionally described as perfect lubrication - a condition enabling the moving parts of the engine to be supported on an oil film. During the movement of the piston 28 from the bottom dead center (BDC) position 32 to the top dead center (TCD) position 30, the air in the crankshaft housing 18 expands creating a partial vacuum. The crankshaft housing 18 is constructed with an air inlet port 44. A supply air check valve 46 is attached on the crankshaft housing 18 side of the air inlet port 44 and an air filter 48 on the other. The structure permits air to flow into the housing on the upward stroke hereinbefore described. During the movement of the piston 28 from the TDC position 30 to the BDC position 32, the air in the crankshaft housing 18 compresses creating a compressed air/oil droplet crankcase mixture. Correspondingly, the crankshaft housing 18 is constructed with an oil barrier or filter 50 and an air outlet port 52. A compressed air check valve 54 is attached on the crankshaft housing 18 side of the air outlet port 52 and an intercooler 56 on the other. The structure permits compressed air, which has been separated from the oil droplets, to flow from the housing to the intercooler 56 on the downward stroke hereinbefore described.

Figure 2:
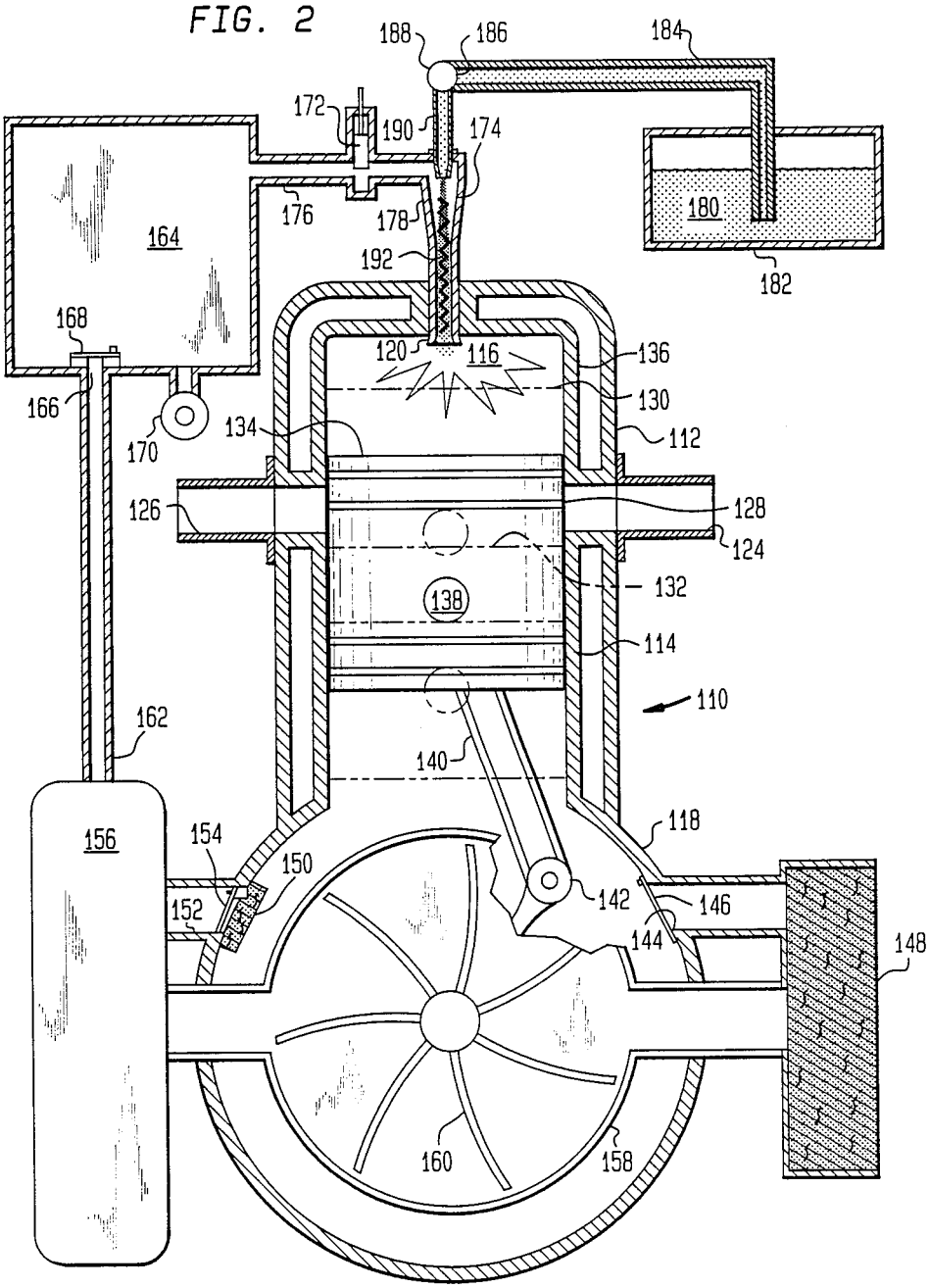

Optionally, the best mode of the invention is structured to include an external air compressor or supercharger 58 powered by engine 10. In the FIG. 2, the compressor 58 is shown schematically as mounted between air filter 48 and intercooler 56; however, a separate air filter and intercooler may optionally be employed. With this arrangement, the compressor or supercharger is constructed to include a turbine 60.

Turning now to the balance of the air supply loop or circuit, much of the novelty of the present invention is at hand. From the intercooler 56, an accumulator inlet conduit or air supply line 62 is structured to provide air to an air accumulator 64. The air supply line 62 is connected to the accumulator 64 at an air inlet port 66. Between the intercooler 56 and the accumulator 64, a flap valve or accumulator check valve 68 prevents the backflowing of air from the accumulator 64. Also, an accumulator relief valve 70 provides safe release of air upon excessive pressure buildup. Significantly, the air supply loop is further constructed to include a programmable air supply metering or throttling valve 72 and a precombustion chamber or nozzle 74. An accumulator outlet conduit 76 interconnects the accumulator 64 and the air supply metering valve 72 and interconnects the air supply metering valve 72 and the upper end 78 of precombustion chamber 74. The precombustion chamber communicates with the precombustion port 20 and, in turn, with combustion chamber portion 16. As will be seen in more detail hereinbelow, the programmable air supply metering valve 72 is structured to provide continual measured air delivery throughout all cycles of the engine. Thereby, the construct promotes a more accurate fuel/air mixture and fast, complete, air assisted exhausting of the products of combustion. This better breathing of the engine is concomitant with the perfect lubrication described above.

Completing the physical description of the engine 10, the fuel supply is next discussed. A supply of fuel 80 is held in a tank 82. A fuel line 84 is connected to an inlet 86 of fuel injector pump 88 which is by mechanical or electronic means controllable to inject through a fuel injector 90 a predetermined quantity or predeterminedly variable quantities of fuel into the upper end 78 of precombustion chamber 74. As fuel injection arrangements are known in the prior art, no attempt is made herein to describe this in detail. The supercharged air from air accumulator 64 and the fuel 80 as pumped through fuel injector 90 are directed against a baffle or mixing vanes 92 in the precombustion chamber 74. Additionally to provide for ignition of the combustible mixture, a spark plug 94 is mounted in ignition port 22.

In the preferred embodiment which follows, a second embodiment is shown being adapted for use in a diesel-type design. In the description of this engine, for convenience corresponding parts of the first embodiment are provided with numbers that are "100" digits higher. Thus, "piston 28" in the first embodiment becomes "piston 128" in the second embodiment.

Referring now to FIG. 1, a portion of the two-cycle internal combustion engine is shown schematically. The engine shown is referred to generally by the numeral 110. The engine 110 is contructed with a cylinder 112 having a cylinder wall 114 extending longitudinally between a combustion chamber portion 116 at one end thereof and a crankshaft housing 118 adjacent the other end thereof. The cylinder wall 114 is further constructed to include a precombustion port 120, and two exhaust ports 124 and 126. Within the cylinder 112, a piston 128 is reciprocally mounted so as to be operable between a top dead center position 130 at which combustion occurs and a bottom dead center position 132 at which exhausting of combustion products occurs. The piston 128 has a crown 134 which, when the piston 128 is at the top dead center position 130, forms with the upper end 136 of cylinder wall 114 the combustion chamber portion 116. Although the cylinder 112 is shown in an orientation with the upper end 136 towards to top of the illustration, the term "upper" refers for convenience to a prescribed portion of the cylinder and is not to be restrictive as to the positioning thereof, such positioning being determined by those skilled-in-the-art. The piston 128 has a piston pin 138 attaching thereto one end of a connecting rod 140 through the lower end of the piston 128. The other end of connecting rod 140 is attached to a crankshaft 142 in the normal manner.

In the diesel two-cycle engine of the present invention, as the crankshaft housing 18 is separated from the combustion/exhaust processes of the engine 110, the shaft and bearing arrangement (not shown) may be structured for what is traditionally described as perfect lubrication - a condition emabling the moving parts of the engine to be supported on an oil film. During the movement of the piston 128 from the bottom dead center (BDC) position 132 to the top dead center (TCD) position 130, the air in the crankshaft housing 118 expands creating a partial vacuum. The crankshaft housing 118 is constructed with an air inlet port 144. A supply air check valve 146 is attached on the crankshaft housing 118 side of the air inlet port 144 and an air filter 148 on the other. The structure permits air to flow into the housing on the upward stroke hereinbefore described. During the movement of the piston 128 from the TDC position 130 to the BDC position 132, the air in the crankshaft housing 118 compresses creating a compressed air/oil droplet crankcase mixture. Correspondingly, the crankshaft housing 118 is constructed with an oil barrier or filter 150 and an air outlet port 152. A compressed air check valve 154 is attached on the crankshaft housing 118 side of the air outlet port 152 and an intercooler 156 on the other. The structure permits compressed air, which has been separated from the oil droplets, to flow from the housing to the intercooler 56 on the downward stroke hereinbefore described.

Optionally, the invention is structured to include an external air compressor or supercharger 158 powered by engine 110. In the FIG. 2, the compressor 158 is shown schematically as mounted between air filter 148 and intercooler 156; however, a separate air filter and intercooler may optionally be employed.

Turning now to the balance of the air supply loop or cxircuit, much of the novelty of the present invention is at hand. From the intercooler 156, an accumulation unlike conduit or air supply line 162 is structured to provide air to an air accumulator 164. The air supply line 162 is connected to the accumulator 164 at an air inlet port 166. Between the intercooler 156 and the accumulator 164, a flap valve or accumulator check valve 168 prevents the backflowing of air from the accumulator 164. Also, an accumulator relief valve 170 provides safe release of air upon excessive pressure buildup. Significantly, the air supply loop is further constructed to include an programmable air supply metering or throttling valve 172 and a precombustion chamber or nozzle 174. An accumulator outlet conduit 176 interconnects the accumulator 164 and the air supply metering valve 172 and interconnects the air supply metering valve 172 and the upper end 178 of precombustion chamber 174. The precombustion chamber communicates with the precombustion port 120 and, in turn, with combustion chamber portion 116. As will be seen in more detail hereinbelow, the programmable air supply metering valve 172 is structured to provide continual measured air delivery throughout all cycles of the engine. Thereby, the construct promotes a more accurate fuel/air mixture and fast, complete, air assisted exhausting of the products of combustion. This better breathing of the engine is concomitant with the perfect lubrication described above.

Completing the physical description of the engine 120, the fuel supply is next discussed. A supply of fuel 180 is held in a tank 182. A fuel line 184 is connected to an inlet 186 of fuel injector pump 188 which is by mechanical or electronic means controllable to inject 178 of precombustion chamber 174. As fuel injection arrangements are known in the prior art, no attempt is made herein to describe this in detail. The supercharged air from air accumulator 164 and the fuel 180 as pumped through fuel injector 190 are directed against a baffle or mining vanes 192 in the precombustion chamber 174.

In operation, it is first noted that supercharging air, although regulated is continuously available to the cylinder 12 and that at the BDC piston position 32, the exhaust ports are uncovered. For convenience, the operational description is begun at ignition and followed through the cycle therefrom. Upon ignition, the air and fuel mixture is combusted, forcing piston 28 downward, creating products of combustion, and transmitting the power through connecting rod 40 to crankshaft 42. As the BDC position 32 is approached, exhaust ports 24 and 26 are uncovered and the continuous flow of compressed air from the air accumulator 64 assists the removal of unwanted products of combustion. The supercharged air assit results in fast and more complete removal of exhaust gases. In the area of the crankshaft housing 18 the downward movement of the piston 28 compresses air and drives the air into the intercooler 56. As the piston 28 reverses, the side of the piston 28 covers the exhaust ports 24 and 26. Upon closure, fuel and supercharger air fill the combustion chamber portion of the cylinder in predetermined amounts and, upon compression, forms an explosive mixture ready for ignition. Simultaneously, as the TDC position 30 is approached, additional air is drawn through air filter 48 and into the crankshaft housing 18. Throughout this activity in the crankcase area, oil is distributed over the connecting rod, cranks, bearings, shafts and journals of the assemblage so that any metal-to-metal contact is avoided because all contact is accompanied by the presence of an intervening oil film. In other words, the engine of the invention is provided with lubrication in the region of perfect lubrication.

In the diesel version the operation is analogous, except that upon piston 128 progressing from BDC position 132 to TDC position 130, auto-ignition occurs.

Although the best mode of the invention has been described herein in some detail, it has not been possible to include each and every variation. Those skilled in the art of two-cycle engines will be able to make slight variations in the mechanical arrangement suggested hereby without departing from the spirit of the invention and still be within the scope of the claims appended hereto.

What is claimed is:

1. A two-cycle internal combustion engine having a cylinder; an ignition means for igniting a combustible mixture of air and fuel; piston means for reciprocal movement between a top dead center position and a bottom dead center position within said cylinder; a connecting rod extending from said piston means and attaching at one end thereof to said piston means; and a crankshaft attached to the other end of said connecting rod, said internal combustion engine comprising, in combination:

a combustion chamber portion at one end of said cylinder for receiving predetermined amounts of air and fuel, said chamber defined by the crown of said piston means and the upper end of the wall of said cylinder and varying between a minimum volume with said piston means at the top dead center position and a maximum volume with said piston means at the bottom dead center position;

inlet port means for injecting fuel and compressed air into the upper end of said combustion chamber portion;

exhaust port means in said cylinder for the conduction of exhaust gases and air from said combustion chamber portion, said exhaust port means being covered and uncovered by the side of said piston means and positioned to be fully uncovered at the bottom dead center position of the piston means;

a fuel/air mixing system in communication with said inlet port means, said system comprising in turn:

air supply means for providing a continuous supply of compressed air to said combustion chamber portion, said supply of compressed air generated by the engine;

fuel supply means for providing predetermined quantities of fuel at specified intervals; and, precombustion chamber means for receiving and mixing said compressed air and said predetermined quantities of fuel and providing the continuously flowing air and the mixture of air and fuel to said inlet port means, said precombustion chamber means being increasingly restrictive along its length from the point of injection to said inlet port means;

a crankshaft housing attached to the lower end of said cylinder and sealed from said combustion chamber portion thereof for housing and lubricating said crankshaft and connecting rod; and, whereby said two-cycle engine provides combustion and exhaust with continuously flowing air through the combustion chamber portion and permits lubrication of the crankshaft in the region of perfect lubrication.

2. An internal combustion engine as described in claim 1 wherein said cylinder has at least two of said exhaust port means.

3. An internal combustion engine as described in claim 1 wherein said air supply means receives compressed air generated external to the crankshaft housing by an air compressor driven by the engine.

4. An internal combustion engine as described in claim 1 wherein the fuel/air mixing system further comprises an air control means.

5. An internal combustion engine as described in claim 4 wherein said air control means is a throttling valve.

6. An internal combustion engine as described in claim 5 wherein said throttling valve is operated by a programmable controller for heating air provided to the precombustion chamber.

7. An internal combustion engine as described in claim 1 wherein said air supply means receives compressed air generated internal to the crankshaft housing and compressed by the downward stroke of the piston.

8. An internal combustion engine as described in claim 7 wherein said air supply means receives compressed air generated external to the crankshaft housing by an air compressor driven by the engine.

9. An internal combustion engine as described in claim 1 wherein said air supply means includes an intercooler for receiving said supply of compressed air generated by said engine and, in turn, delivering said supply to an air accumulator.

10. An internal combustion engine as described in claim 1 wherein said specified intervals for fuel supply occur after the piston fully covers said exhaust ports and as the piston is moving toward the top dead center position.

11. An internal combustion engine as described in claim 10 wherein said fuel supply means is an electronic fuel injector.

12. An internal combustion engine as described in claim 11 wherein said electronic fuel injector is programmatically variable.

13. An internal combustion engine as described in claim 12 wherein the mixture of fuel and air auto ignites upon the piston reaching the top dead center position.

14. An internal combustion engine as described in claim 1 wherein the fuel/air mixing system further comprises a throttling valve in the outlet of the air accumulator, said throttling valve including a programmable controller for metering air provided to the precombustion chamber.

15. A two-cycle internal combustion engine having a cylinder; piston means for reciprocal movement between a top dead center position and a bottom dead center position within said cylinder; a connecting rod extending from said piston means and attaching at one end thereof to said piston means; and a crankshaft attached to the other end of said connecting rod, said internal combustion engine comprising, in combination:

a combustion chamber portion at one end of said cylinder for receiving predetermined amounts of air and fuel, said chamber defined by the crown of said piston means and the upper end of the wall of said cylinder and varying between a minimum volume with said piston means at the top dead center position and a maximum volume with said piston means at the bottom dead center position;

inlet port means for injecting fuel and compressed air into the upper end of said combustion chamber portion;

two or more exhaust port means in said cylinder for the conduction of exhaust gases and air from said combustion chamber portion, said exhaust port means being covered and uncovered by the side of said piston means and positioned to be fully uncovered at the bottom dead center position of the piston means;

a fuel/air mixing system in communication with said inlet port means, said system comprising in turn:

air supply means for providing a continuous supply of compressed air to said combustion chamber portion, said supply of compressed air generated by the engine;

said supply means including intercooler means for receiving said signal of compressed air generated by said engine and, air accumulator means for receiving said supply from said intercooler;

fuel supply means for providing predetermined quantities of fuel at specified intervals; and, precombustion chamber means for receiving and mixing said compressed air and said predetermined quantities of fuel and providing the continuously flowing air and the mixture of air and fuel to said inlet port means, said precombustion chamber means being increasingly restrictive along its length from the point of injection to said inlet port means;

a crankshaft housing attached to the lower end of said cylinder and sealed from said combustion chamber portion thereof for housing and lubricating said crankshaft and connecting rod; and, whereby said two-cycle engine provides combustion and exhaust with continuously flowing air through the combustion chamber portion and permits lubrication of the crankshaft in the region of perfect lubrication.

16. An internal combustion engine as described in claim 15 wherein said cylinder has at least two of said exhaust port means.

17. An internal combustion engine as described in claim 15 wherein said specified intervals for fuel supply occur after the piston fully covers said exhaust ports and as the piston is moving toward the top dead center position.

18. An internal combustion engine as described in claim 17 wherein said fuel supply means is an electronic fuel injector.

19. An internal combustion engine as described in claim 18 wherein said electronic fuel injector is programmatically variable.

* * * * *